US005464169A

United States Patent [19]

Henseler et al.

[11] Patent Number: 5,464,169

[45] Date of Patent: Nov. 7, 1995

[54] WINDING DEVICE FOR SHEETS OF PAPER OR CARDBOARD

[75] Inventors: Klaus Henseler, Heidenheim; Rudolf Beisswanger, Steinheim, both of Germany

[73] Assignee: J. M. Voith GmbH, Germany

[21] Appl. No.: 34,552

[22] Filed: Mar. 19, 1993

[30] Foreign Application Priority Data

Mar. 19, 1992 [DE] Germany ..... 42 08 790.2

[51] Int. Cl.[6] ..... B65H 18/20

[52] U.S. Cl. ..... 242/542; 242/542.4; 162/358.3

[58] Field of Search ..... 242/65, 66, 542, 242/542.4; 162/358.3; 492/6, 7, 20; 100/162 B, 164

[56] References Cited

U.S. PATENT DOCUMENTS

| | | | |
|---|---|---|---|
| 3,098,619 | 7/1963 | Washburn | 242/66 |
| 3,412,950 | 11/1968 | Martin, Sr. | 242/66 |
| 3,515,183 | 6/1970 | Voss | 242/66 |
| 4,555,305 | 11/1985 | Steiner et al. | 162/358.3 X |
| 4,563,245 | 1/1986 | Wanke et al. | 162/358 |
| 4,584,059 | 4/1986 | Schiel et al. | 162/358.3 X |
| 5,026,005 | 6/1991 | Eurola | 242/65 |
| 5,106,029 | 4/1992 | Eurola | 242/65 |
| 5,150,850 | 9/1992 | Adams | 242/66 |

*Primary Examiner*—John P. Darling

*Attorney, Agent, or Firm*—Ohlandt, Greeley, Ruggiero & Perle

[57] ABSTRACT

A winding device for paper or cardboard with at least two axis-parallel support elements for the sheet winding, which extend at least over the length of the sheet winding (T) and of which at least one is a carrier roll (2). The other support element has a rigid carrier (4), which guides the sheet winding over a sheath (7, 7') arranged in a rotating manner around the carrier or guided in a flexible tubing manner, and a carrying shoe (5, 5') combined with it and acting hydrodynamically with respect to sheath (7, 7'), which carrying shoe is provided with a concave pressure surface whose radius of curvature essentially corresponds to the maximum winding (T) including the sheath wall thickness, whereby carrying shoe (5, 5') can be adapted in its position to the size (position of the periphery) of the sheet winding (W') which is wound and present each time.

8 Claims, 3 Drawing Sheets

WINDING DEVICE FOR SHEETS OF PAPER OR CARDBOARD

BACKGROUND OF THE INVENTION

The invention concerns a winding device for a sheet of paper or cardborad. Such a device is known from DE 3,221,929 C3. Such so-called double-carrier-roll winding devices have the disadvantage that prior to reaching the maximum size, disruptive spots or even breaks can occur in the winding construction due to the high linear compression of the sheet winding. It is also difficult, in the case of very large winding diameters, to maintain constant the support pressure over the entire winding length. In the case of support roll machines, windings are conducted in two tension pins. In this way, it is possible to take up an arbitrary portion of the roll weight by unloading devices and to reduce correspondingly the pressure of the winding. These devices, however, are very expensive.

The task of the invention is to create a winding device, in which two support elements are constructed or arranged in such a way that the linear pressure on the sheet winding remains relatively small, so that comparatively large diameters of the winding can be obtained.

This task is resolved according to the invention by a winding device having at least two support elements that extend over the length of the sheet, one support element being a carrier roll and the other including a rigid carrier for guiding the sheet; a sheath arranged around the carrier; a carrying shoe connected to the carrier for hydrodynamically reacting with the sheath; a concave pressure surface adapted to mate with the carrying shoe and having a radius of curvature that essentially corresponds to a maximum winding of the sheet, whereby the carrying shoe is adapted to be continually positioned at the periphery of the sheet.

In fact, pressure devices with rolls or roll-type pressure elements are known, in which one of the pressing elements is a so-called tubular roll (see U.S. Pat. No. 4,563,245). Thus, one of the pressing elements is a tube-shaped surrounding sheath pressed by a pressing shoe, whereby sheath and pressing shoe are held by a rigid, often tube-shaped carrier. According to the invention, however, it was recognized that the latter can be used for pressing fixtures on a device known in and of itself, but with the corresponding changes in order to reduce the linear pressure of the winding.

Therefore, advantageously, one proceeds by adapting the pressing shoe to the respective position or to the size of the winding in order to consistently provide a sufficient guidance and support of the latter.

Thus one can proceed once by shifting the pressing shoe preferably called the carrying shoe) along a circumferential path, whereby the carrying shoe is rigidly bound with a carrier-particularly of cylinder form, which is then rotated around its longitudinal axis in order to turn the carrying shoe to the necessary position. The carrying shoe can also be arranged in a turning manner on a central carrier, which can be configured also in a hollow cylindrical shape. Hydraulic piston cylinder units can then serve as lifting elements. It is also possible to provide flexible pressure tubing between the carrier and the carrying shoe. This has the advantage that it supports the carrying shoe over its entire length. In order to prevent a sagging of the latter, the shoe can be formed thinner than if piston rods were engaged on its ends.

BRIEF DESCRIPTION OF THE DRAWINGS

The invention will be explained in the following on the basis of the examples shown in the figures of the drawing; therefore.

DESCRIPTION OF THE PREFERRED EMBODIMENTS

Figure 1:
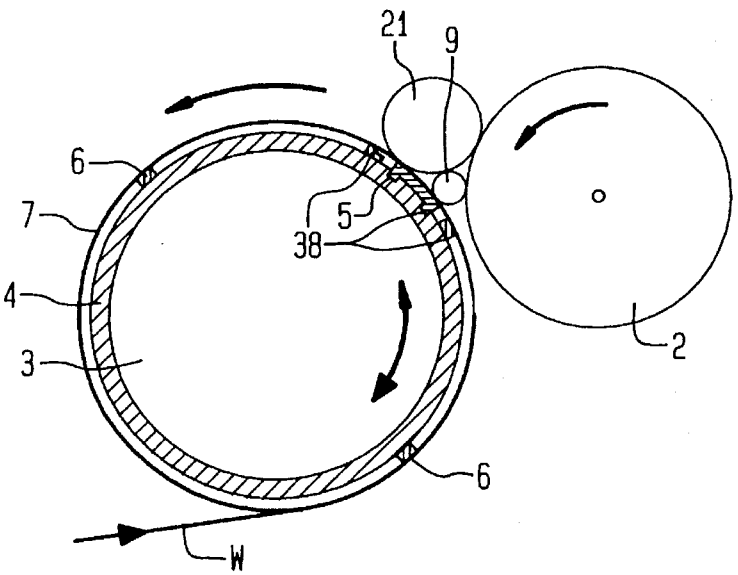

According to FIG. 1, a circular cylindrical hollow carrier 4 is provided for the flexible tubing-type sheath 7, which carrier has support elements, or carrier strips 6 for the sheath. These elements can be hydrodynamically lubricated or operate in order to guide the sheath, e.g., not only during mounting, but also in operation. A carrying shoe 5 extending over the length of the carrier or above the paper sheet width is attached onto one place on carrier 4, which shoe has a running surface,with respect to the sheet winding W' of FIG. 3, which is hydrodynamically lubricated and is formed concavely corresponding to the maximum winding diameter of drum T shown in FIG. 2. In this case, sheet W is guided over the flexible sheath. The rigid carrier roll 2 for the winding is driven. Winding tube 9 is here pressed against the bearing surfaces by a compressing roll 21. In this arrangement, the flexible tubing-type sheath 7 can be preferably driven, e.g., by front disks corresponding to DE 3,806,350 C2. It is also possible to provide a friction drive over the circumference of the sheath, as is indicated in FIG. 3. However, the sheet can also be guided over carrier roll 2 shown in FIG. 3.

It is of course important that carrying shoe 5 (5' in FIG. 3) is arranged at a considerably lower level (at least approximately 100 mm) than the uppermost sheath line or sheath-generating line of the rigid carrier roll 2, so that the carrying shoe bears the larger proportion of the winding weight.

In the beginning of the winding process, only the small winding rod 9 is present, and this starts the winding process, whereby carrying shoe 5 is arranged at a rather low position, due to the still small winding diameter. With increasing winding diameter, carrying shoe 5 is turned more and more toward the top simply by rotating carrier unit 4 along its longitudinal axis so that, as in the case of conventional double-carrier-roll rollers, the latter is carried on two elongated regions, which are at a distance from each other on the periphery of the winding. Of course, the radius of curvature of carrying shoe 5 does not correspond to the smaller diameter of the winding, so that here there is no essential advantage when compared with the conventional double-carrier-roll rollers. However, as soon as the winding has a size in the region of its maximum diameter, the bearing surface on which the winding is supported on carrying shoe 5 increases considerably. (It is already known that even in the case of a roll with a hard, smooth surface, a pressing surface is produced of a length in the circumferential direction between 20 and 25 for large winding diameters and correspondingly large drum weights.)

Figure 2:
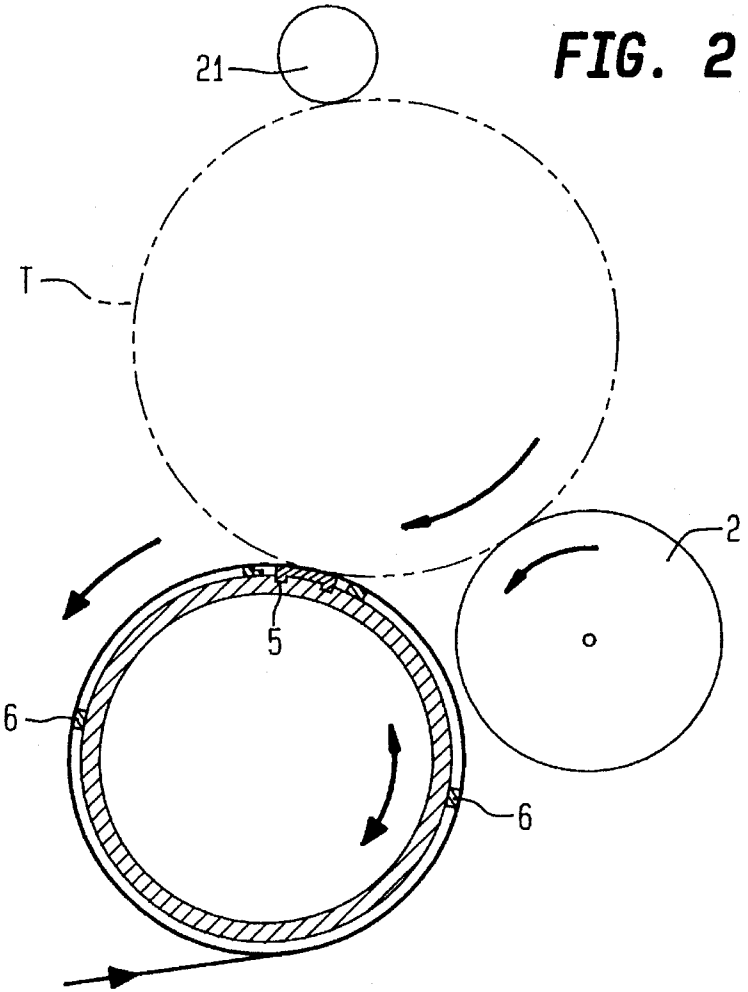
FIGS. 1 and 2 each represent, in principle, a front view—partially in section—of a first embodiment of the invention.
Figure 3:
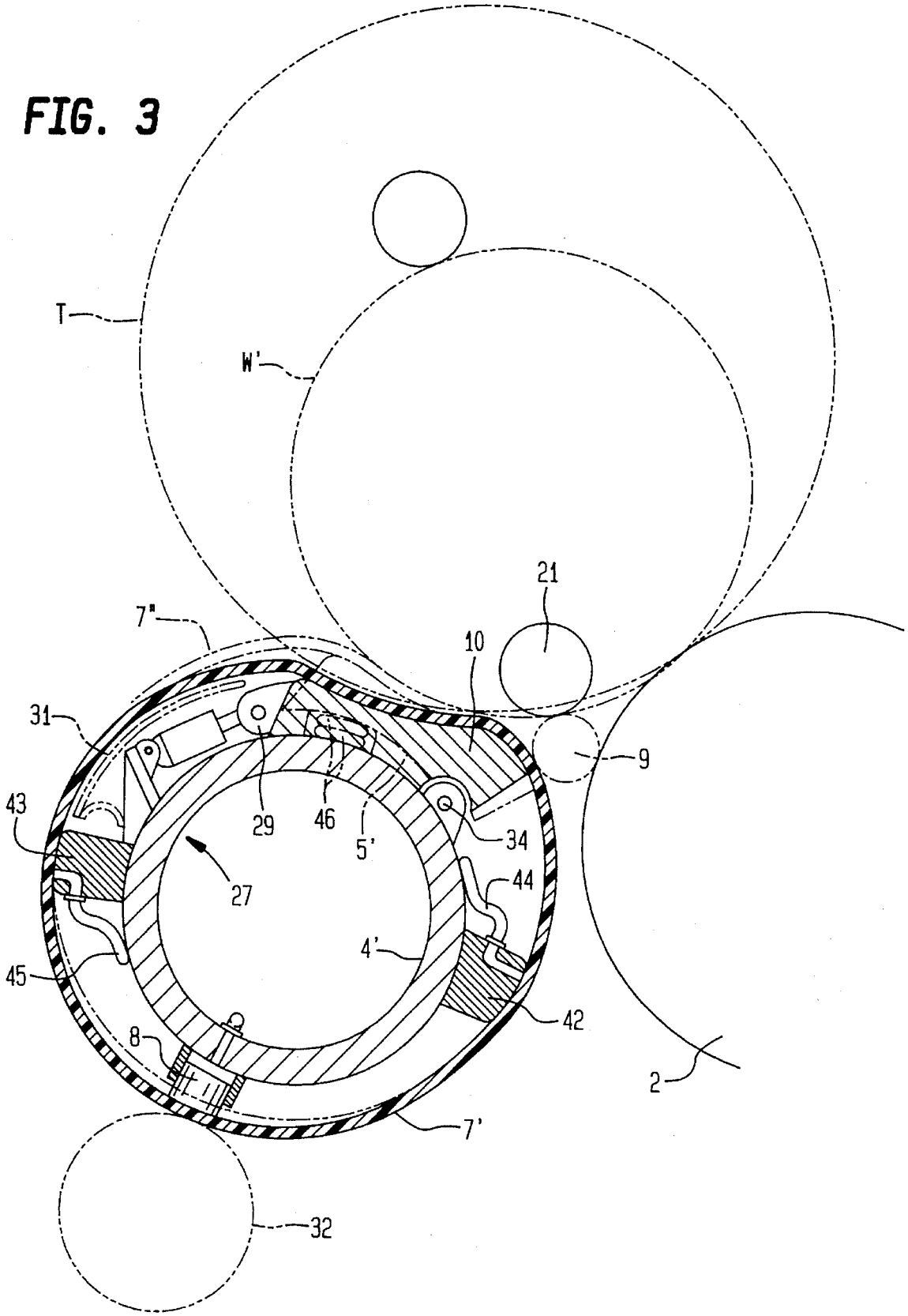
FIG. 3 represents a cut-away view of another form of embodiment.

The uppermost position of carrying shoe 5 for the completed winding diameter is shown in FIG. 2. In the figures, lines 38 are indicated for carrying shoe 5 and other carrier strips. It is also possible that the sheaths are sealed by carrier strips and the front end of the sheath is subject to an overpressure inside by means of compressed air, so that it surrounds carrier 4 in a relatively "round" shape without guiding by carrier strips 6.

As can be seen from FIG. 2, carrying shoe 5 is arranged such that it takes up the primary weight of drum T relative to the other carrier roll 2.

A necessary lubricating film can be formed for overwinding the breakaway moment during winding up, by guiding a lubricant standing under high pressure between the sheath and the carrying shoe in the region of the applied rod. Also, winding up can be supported by compressed air introduced into the roll insofar as this state is not maintained continually. The "diameter" of the sheath roll, the flexible roll sheath, should be selected relatively large, e.g., larger than 800 mm. In this way, the necessary rpm in order to produce a specific drum diameter is relatively smaller, so that the service life of the sheath is increased.

The sheath for the case provided in FIG. 1 can be favorably loaded in an electrostatic manner in order to support the sheet intake and the sheet separation.

Levers, which engage on the front end of carrier 4 and which are actuated, for example, by hydraulic lifting elements can serve as a turning device.

An embodiment is shown in FIG. 3 with respect to the representation in FIG. 1, in which the carrying shoe 5' is arranged on the tube-shaped carrier 4' with circular cylindrical cross section, in a rotating manner around an axis parallel to the longitudinal axis of the carrier or of the sheet winding. The turning motion is effected by hydraulic or pneumatic lifting element or piston cylinder units 27, which engage on clips 29 of the carrying shoe. Sheath 7' is then guided over carrier blocks 42 and 43, for which additional lubricating lines 44 and 45 are indicated. Another bearing element is a carrying shoe 8, in this case actuated hydrodynamically more effectively than a piston, which shoe is essentially arranged diametrically opposite carrying shoe 5', and to which a drive roll 32 is assigned in this case, which roll engages on the periphery of the flexible tubing-type sheath 7'. This drive can also only be provided for the initial time period, during which the sheet winding is still relatively small and still does not have a great weight.

In the beginning of the winding process, when essentially only rod 9 is present or wrapped with a few windings, carrying shoe 5' is shown in the position represented by the solid line. It has in its region found opposite carrier roll 2, a carrier part 10 with a convexly curved bearing surface in order to carry the winding rod and the winding of small diameter. As soon as the sheet winding has reached a certain size, the carrying shoe is turned upward around axis 34 into position 7" shown by the dotted line in order to assure a guidance and bearing of the winding that is free of objection. A concave carrying surface of the carrying show 5' turns toward the carrier roll 2 such that winding rod 9 is positioned advacent to the concave carrying surface and carrier roll for winding the sheet W into a very small diameter.

Practically the same effect is obtained here by the turning of the carrying shoe as in the device according to FIGS. 1 and 2. If the sheet winding reaches approximately the size W' shown, then the carrying shoe is generally turned under again until it reaches the position shown by the solid line, in order to finally in the same way also carry the drum with the greatest winding diameter.

If a very large diameter is selected for the flexible sheath 7 or 7' of at least 1500 mm, and the "second carrier roll" 2 is arranged relatively far above with respect to the flexible sheath, the surface pressure can be extensively reduced and thus permit a very large sheet winding diameter.

As shown by the dotted line, the turning of carrying shoe 5' can be produced by means of flexible pressure tubing 46, shown by the dotted lines, instead of piston cylinder units 27. The shoe can thus be designed with a smaller wall thickness, since it is supported over its entire length by the flexible pressure tubing. Its sagging primarily in the center or in the central regions of the sheet winding, is essentially small as a result, and the outer diameter of the hollow cylindrical carrier unit 4' can possibly be designed larger for the given diameter of the flexible sheath.

The running up of sheath 7' at "corner" parts, like the holder of piston cylinder unit 27, can also be avoided by a protective plate 31.

Figure 4:
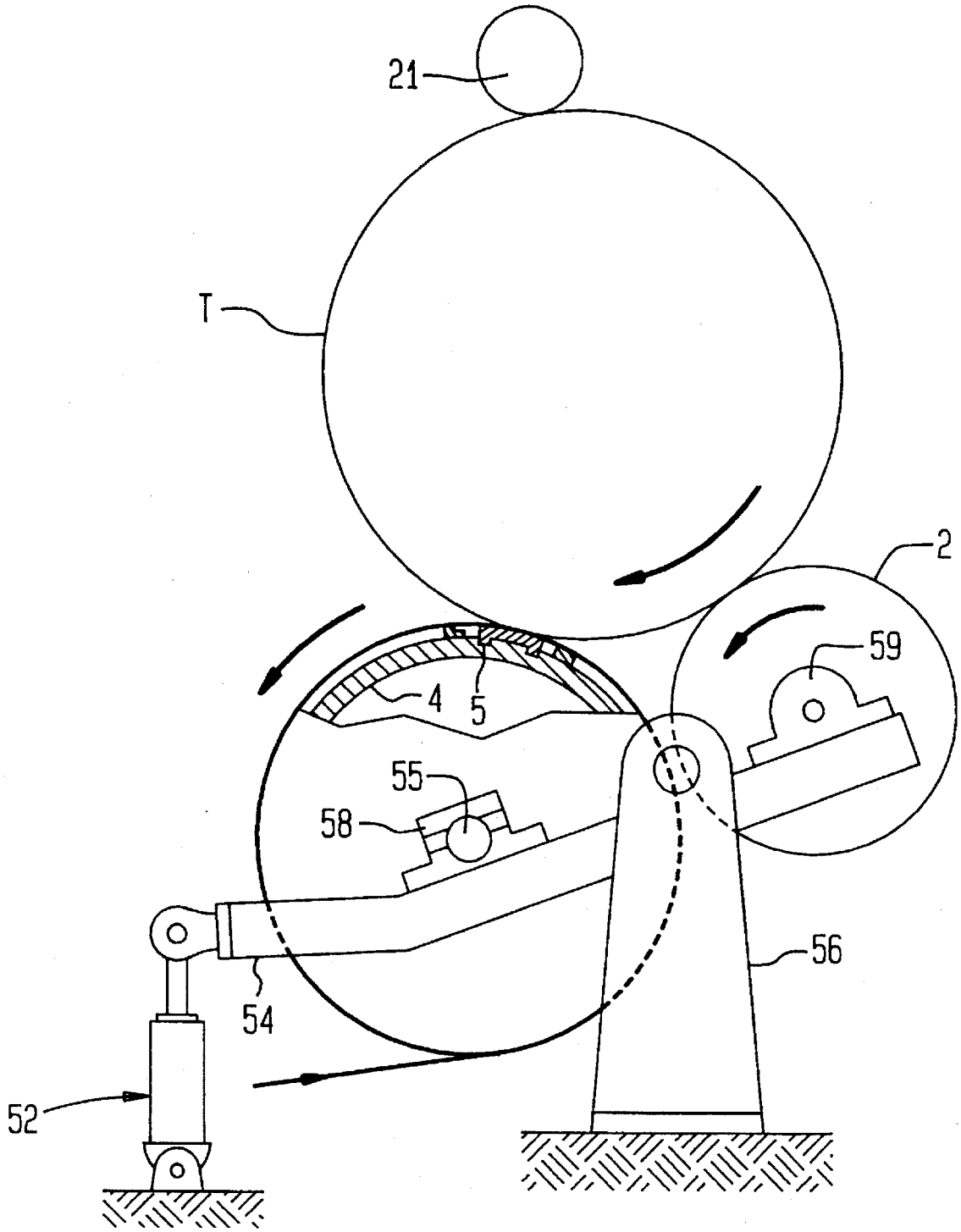
FIG. 4 represents another embodiment.

An arrangement is depicted in FIG. 4, in which the rolls are arranged on a two-arm lever 54, whereby carrier 4, 55 of flexible sheath 7 is found on one arm and rigid carrier roll 2 is found on the other arm, each with assigned bearings 58 or 59. Such levers are, of course, provided on both ends of the rolls. The movement of the levers is produced by means of lifting elements 52, preferably hydraulic cylinder piston units. The levers are supported on stands 56. An adaptation of the position of carrying shoe 5 to the different winding diameters can possibly also be undertaken by this arrangement. In any case, an accurate adaptation of the position of the carrier rolls with respect to vibration-free operation of the device can be produced.

Here the variants according to FIGS. 1 and 2 are considered, whereby carrier 4 is supported by means of journal 55.

We claim:

1. A winding device for winding a sheet of paper or cardboard, the winding device comprising:

at least two support elements that extend over the length of the sheet, one of the at least two support elements being a carrier roll, the other of the at least two support elements including a rigid carrier for guiding the sheet;

a sheath arranged around the carrier;

a carrying shoe connected to the carrier and located within an inner boundary of the sheath; and a concave surface provided on a portion of the carrying shoe and having a radius of curvature that essentially corresponds to a maximum winding radius of the sheet, whereby the carrying shoe is adapted to be continually positioned at the periphery of the winding radius.

2. The winding device according to claim 1, wherein the carrying shoe is adapted to shift about the periphery of the sheet and is positioned along the periphery of the carrier.

3. A winding device for winding a sheet of paper or cardboard, the winding device comprising:

at least two support elements that extend over the length of the sheet, one of the at least two support elements being a carrier roll, the other of the at least two support elements including a rigid carrier for guiding the sheet;

a sheath arranged around the carrier:

a carrying shoe connected to the carrier and located within an inner boundary of the sheath;

a concave surface provided on a portion of the carrying shoe and having a radius of curvature that essentially corresponds to a maximum winding radius of the sheet whereby the carrying shoe is adapted to be continually positioned at the periphery of the sheet; and wherein the carrying shoe is joined rigidly to the carrier and is adapted to turn with the carrier as the carrier rotates about its longitudinal axis.

4. A winding device for winding a sheet of paper or cardboard, the winding device comprising:

at least two support elements that extend over the length of the sheet, one of the at least two support elements being a carrier roll, the other of the at least two support elements including a rigid carrier for guiding the sheet;

a sheath arranged around the carrier;

a carrying shoe connected to the carrier and located within an inner boundary of the sheath, wherein the carrying shoe is adapted to shift in relation to the periphery of the sheet and turn with the carrier as the carrier rotates about its longitudinal axis and is positioned along the periphery of the carrier; and a concave surface provided on a portion of the carrying shoe and having a radius of curvature that essentially corresponds to a maximum winding radius of the sheet, whereby the carrying shoe is adapted to be continually positioned at the periphery of the sheet.

5. A winding device for winding a sheet of paper or cardboard, the winding device comprising:

at least two support elements that extend over the length of the sheet, one of the at least two support elements being a carrier roll, the other of the at least two support elements including a rigid carrier for guiding the sheet;

a sheath arranged around the carrier;

a carrying shoe connected to the carrier and located within an inner boundary of the sheath;

a concave surface provided on a portion of the carrying shoe and having a radius of curvature that essentially corresponds to a maximum winding radius of the sheet, whereby the carrying shoe is adapted to be continually positioned at the periphery of the sheet; and wherein the carrying shoe is connected to the carrier and rotatable therewith around an axis parallel to a longitudinal axis of the carrier and wherein the carrying shoe has a concave carrying surface that turns toward the carrier roll, and wherein a winding rod is positioned adjacent the concave carrying surface and the carrier roll.

6. The winding device according to claim 5, further comprising at least one lifting element positioned between the carrying shoe and the carrier for turning the carrying shoe around an axis located a predetermined distance from one of the at least one lifting element.

7. The winding device according to claim 6, wherein the at least one lifting element is a hydraulic lifting element.

8. The winding device according to claim 6, wherein the at least one lifting element is a pneumatic lifting element.

* * * * *